US006699560B1

(12) United States Patent
Schulte

(10) Patent No.: US 6,699,560 B1
(45) Date of Patent: Mar. 2, 2004

(54) FLOOR CARPET INSTALLING SYSTEM

(75) Inventor: Axel Schulte, Holzgerlingen (DE)

(73) Assignee: Gottlieb Binder GmbH & Co., Holzgerlingen (DE)

( * ) Notice: Subject to any disclaimer, the term of this patent is extended or adjusted under 35 U.S.C. 154(b) by 0 days.

(21) Appl. No.: 09/601,279

(22) PCT Filed: Sep. 22, 1998

(86) PCT No.: PCT/EP98/06020

§ 371 (c)(1),
(2), (4) Date: Jul. 31, 2000

(87) PCT Pub. No.: WO00/16670

PCT Pub. Date: Mar. 30, 2000

(51) Int. Cl.[7] ..... B32B 3/02; B32B 3/06; B32B 33/00; B32B 7/10

(52) U.S. Cl. ..... 428/95; 428/96; 428/99; 428/100; 428/343

(58) Field of Search ..... 428/95, 96, 99, 428/100, 343

(56) References Cited

U.S. PATENT DOCUMENTS 4,822,658 A * 4/1989 Pacione ..... 428/100
5,380,574 A * 1/1995 Katoh et al. ..... 428/92
5,382,462 A * 1/1995 Pacione ..... 428/100
5,658,430 A * 8/1997 Drake et al. ..... 156/71
5,902,427 A * 5/1999 Zinke et al. ..... 156/290
6,217,974 B1 * 4/2001 Pacione ..... 428/95
6,287,665 B1 * 9/2001 Hammer ..... 24/452

FOREIGN PATENT DOCUMENTS

| | | | |
|---|---|---|---|
| DE | 19532685 | 3/1997 | |
| DE | 19646318 | 5/1998 | |
| FR | 202476 | 7/1970 | |
| WO | 8601247 | 2/1986 | |
| WO | WO 9641716 A1 * | 12/1996 | ..... B32B/3/00 |

OTHER PUBLICATIONS

Excerpt from US 3,556,465 issued to Little in 1971.*
Excerpt from US 3,593,840 issued to Guyer in 1971.*
Excerpt from US 5,350,388 issed to Epstein in 1994.*
English abstract of DD 290 477 A issued to Irmscher in 1991.*

* cited by examiner

*Primary Examiner*—Cheryl A. Juska
(74) *Attorney, Agent, or Firm*—Roylance, Abrams, Berdo & Goodman, LLP

(57) ABSTRACT

A system for installing floor carpets includes a carpet whose nap side forms the useful surface. An anchor can be fixed to the floor, and has protuberant interlocking elements that interlock with the backside of the carpet opposite the nap side. The backside of the carpet facing the anchor is formed by a material having no loops. A micro-adhesive closure with interlocking elements in the form of fingers with thickenings on their ends is provided as the anchor to interlock with the loopless backside of the carpet.

10 Claims, 2 Drawing Sheets

FLOOR CARPET INSTALLING SYSTEM

FIELD OF THE INVENTION

The present invention relates to a floor carpet installation system with the useful surface of the carpet being formed by its nap side and with an anchoring means that can be fixed to the floor. The anchoring means has protuberant mushroom-shaped elements having the form of fingers with thickenings at their ends. The elements are in interlocking engagement with the backside of the carpet formed of a loopless material, opposite the nap side.

BACKGROUND OF THE INVENTION

A floor carpet installation system is disclosed in DE 195 32 685 A1. In that system a mushroom strip is provided as anchoring means to be fastened to the floor. The anchoring means has upwardly protuberant mushroom-shaped interlocking elements with thickened ends that interlock together with a felt layer. The felt layer forms the backside of the carpet to be installed. This type of anchoring of the carpet incorporates certain inadequacies. In particular, this type of anchoring does not form a sufficiently secure connection for the prevention of sliding along the carpet plane. As a result, buckling and bulges can occur during use, especially with higher stresses, for example by sliding of heavy pieces of furniture, leading to a greater danger of damage.

SUMMARY OF THE INVENTION

Objects of the present invention are to provide a floor carpet installation system which guarantees a comparably improved anchoring between carpet and floor.

With a floor carpet installation system according to the present invention, these objects are provided by a micro-adhesive closing member provided as the anchor. Thicknesses of the fingers of the interlocking elements of the anchor have the shape of plate-like heads. The heads are provided on the top with concave depressions. The depressions are provided with an adhesive causing additional connection with the backside of the carpet.

In this manner an especially fixed connection is attained in relation to relative movements along the carpet plane. Since longitudinal sliding is definitely prevented, no danger exists of arching or buckling, even with greater stress.

A micro-adhesive closing member which is particularly suitable for the system according to the present invention is disclosed in DE 196 46 318 A1. In this case, according to the material make-up of the carpet to be installed, particularly the structure of the carpet backside, a micro-adhesive closing with a thickness of the carrier of the interlocking elements of 0.1 to 0.5 mm and with 20 to 600 interlocking elements per $cm^2$ can be used.

One method for especially simple manufacture of microadhesive closings having interlocking elements with plate-like heads, whereby the heads are provided on their tops with concave depressions, is disclosed in German patent application 198 28 856.5.

The depressions of the heads can be provided with the adhesive, providing an additional connection with the backside of the carpet, for example, by scraping the adhesive on the heads.

Textile materials in the form of felts or fleeces can be provided as the backside of the carpet. Also, loose leno weave or flat knitted blank, as found in non-woven textiles or materials can be used.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
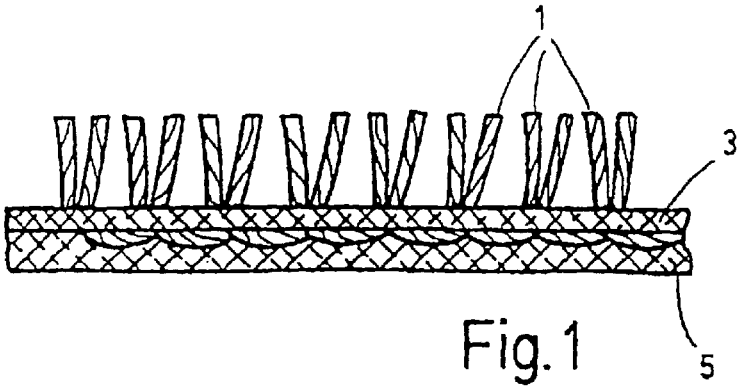
FIG. 1 is a diagrammatically simplified, side elevational view in section of a floor carpet with an open nap and loopless backside according to the present invention.

FIG. 1 shows an enlarged, diagrammatic simplified representation of a cross section through a floor carpet with nap elements 1 of the traditional or conventional type. The nap elements extend upward from a connection layer 3, and form the nap side of the carpet to serve as the useful surface. The backside 5, opposite the nap side, is formed by a material having no loops. For this purpose, the backside materials can lend the carpet structure a certain degree of rigidity, alignment stability and tear resistance. For this purpose felt or fleece can be used, which attain their mechanical composition by the tufting method and are glued together with connection layer 3 of the carpet. Loose leno weaves, flat knitted blanks and other so-called non-woven materials are also suitable for this purpose.

Figure 2:
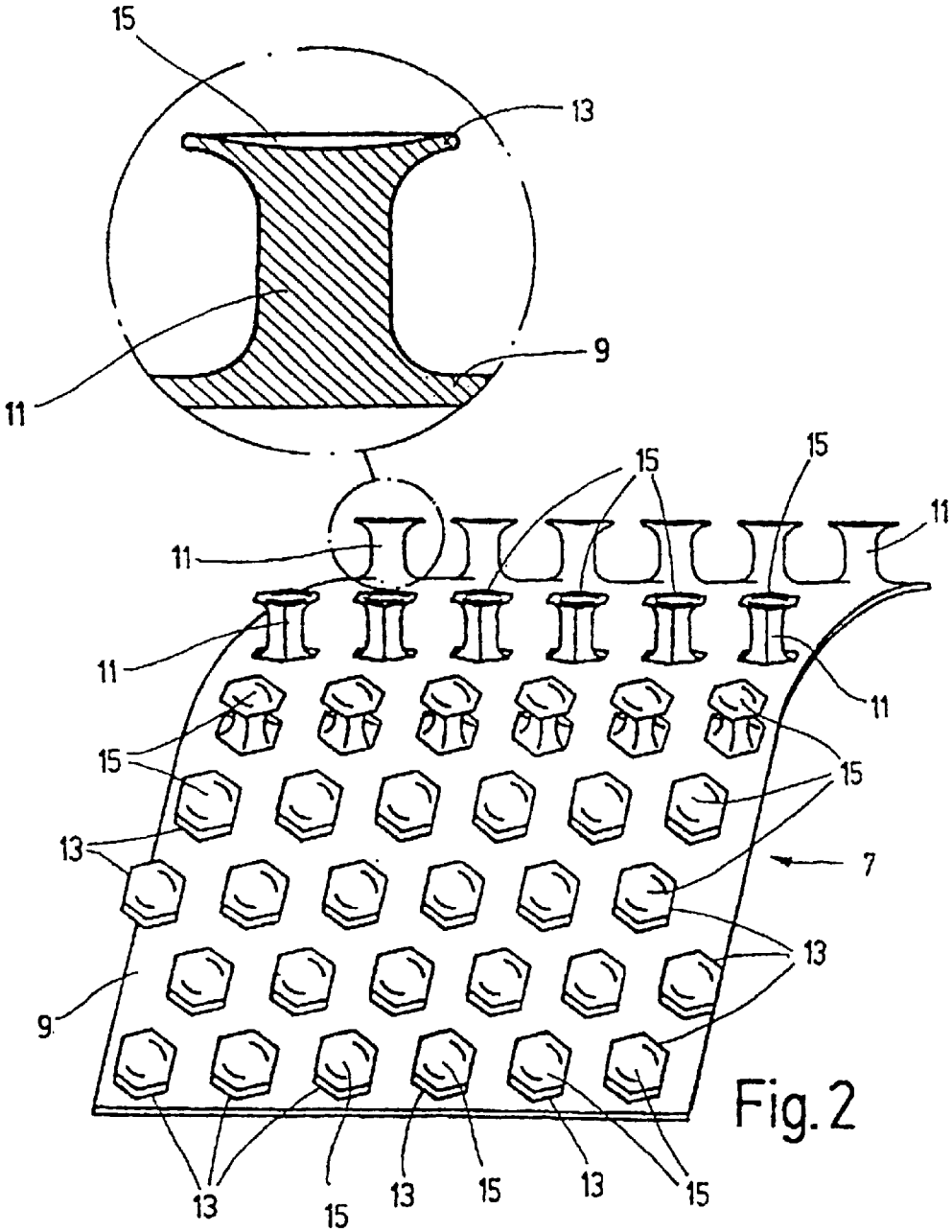
FIG. 2 is an enlarged perspective view of a microplast-adhesive closing component with a greatly enlarged side elevational view in section of one individual interlocking element.

FIG. 2 shows a section of a strip of a microplast-adhesive closing component 7 as disclosed in DE 196 46 318 A1. The thermoplastic strips (which may be, for example, polyolefin or a blend of polyamides) are formed in the gap between a pressing tool and a molding tool and form a foil-like carrier 9 with fingers 11 protruding out of its top. According to the mechanical construction and fineness of the structure of backside 5 of the relevant carpet, the arrangement of fingers 11 has a finger density of approximately 20 to 600 fingers 11 per $cm^2$. The thickness of carrier 9 is approximately 0.1 to 0.5 mm. Other finger densities and/or thicknesses of carrier 9 can of course come into consideration according to special circumstances.

As can be seen, especially from the sectional representation shown greatly enlarged in FIG. 2, the thickened heads 13 of fingers 11 are shaped into mushroom- or plate-shapes. The head top surfaces are concave topside, forming a depression 15 within the edges of each head 13.

Figure 3:
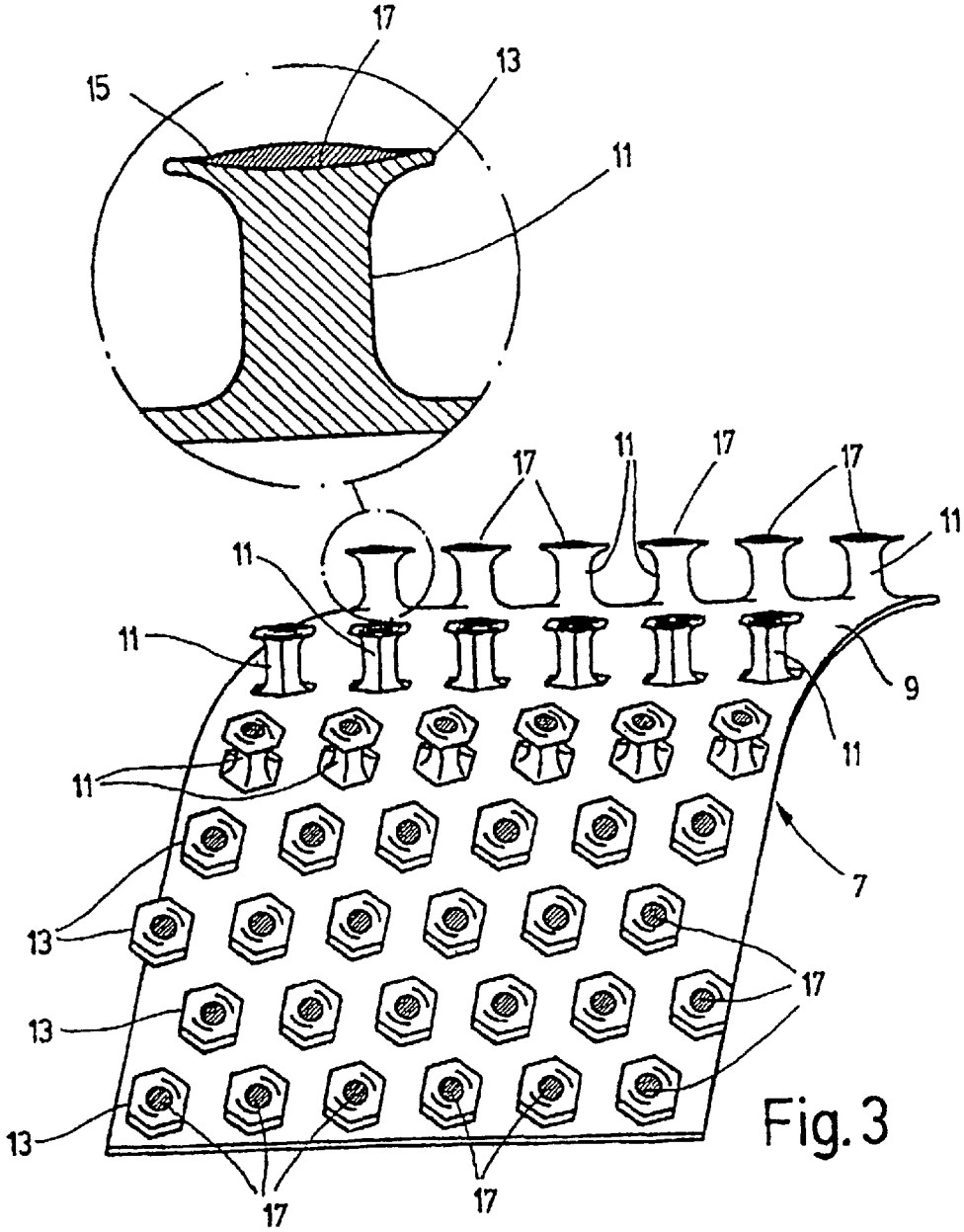
FIG. 3 are perspective and side elevational views corresponding to those of FIG. 2, but with the depressions on the tops of the heads of the interlocking elements being provided with adhesive.
Figure 4:
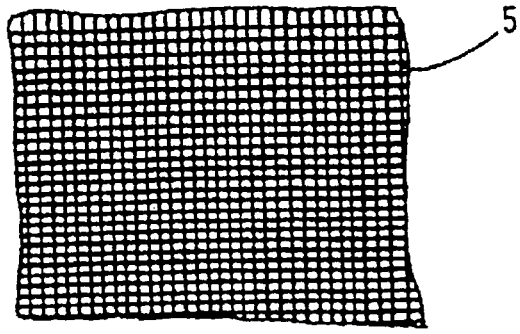
FIG. 4 is a partial plan view, in almost normal dimensions, of the loopless material backside of the carpet of FIG. 1.

With the example shown in FIG. 3, depressions 15 of heads 13 are filled with adhesive 17. This adhesive can be applied by spreading on or scraping on, in order to cause an additional composite binding effect, following the interlocking engagement with backside 5 of the relevant carpet. For example an adhesive on acrylate base, for instance 2-ethyl hexyl acrylate or butyl acrylate can be used as an adhesive, in various different selected mixture ratios, in order to vary the plasticizing and the plasticity and adhesive power as desired and as required.

With installation of wall-to-wall carpets, adhesive closing component 7 can be provided in the form of long strips or bands. With installation of the carpet in sections, shorter, individual strip segments can be provided in a suitable manner.

While an embodiment has been chosen to illustrate the invention, it will be understood by those skilled in the art that various changes and modifications can be made therein without departing from the scope of the invention as defined in the appended claims.

What is claimed is:

1. A floor carpet installation system, comprising:

a carpet having a nap side forming a useful surface thereof and having a backside opposite said nap side;

a loopless material fixed on said backside of said carpet; and a micro-adhesive closing component fixable to a floor and having upwardly protruding mushroom-shaped interlocking elements on a carrier, said interlocking elements having fingers with mushroom-shaped heads at ends thereof remote from said carrier interlockingly engaged with said loopless material, said heads having concave depressions on top surfaces thereof receiving adhesive to provide an additional connection with said backside of said carpet.

2. A floor carpet installation system according to claim 1 wherein said adhesive has an acrylate base.

3. A floor carpet installation system according to claim 1 wherein said loopless material is felt.

4. A floor carpet installation system according to claim 1 wherein said loopless material is fleece.

5. A floor carpet installation system according to claim 1 wherein said loopless material is a weave.

6. A floor carpet installation system according to claim 1 wherein said loopless material is a knit.

7. A floor carpet installation system according to claim 1 wherein said loopless material is non-woven.

8. A floor carpet installation system according to claim 7 wherein said non-woven textile is of synthetic materials.

9. A floor carpet installation system according to claim 7 wherein said non-woven textile is needle punched felt.

10. A floor carpet installation system according to claim 1 wherein a backside of said closing component is connected to the floor by adhesive.

* * * * *